US007258431B2

(12) United States Patent
Shinada et al.

(10) Patent No.: US 7,258,431 B2
(45) Date of Patent: Aug. 21, 2007

(54) INK CARTRIDGE FOR INK-JET RECORDING APPARATUS

(75) Inventors: Satoshi Shinada, Nagano (JP); Atsushi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/025,821

(22) Filed: Dec. 26, 2001

(65) Prior Publication Data

US 2002/0085075 A1 Jul. 4, 2002

(30) Foreign Application Priority Data

Dec. 25, 2000 (JP) ..... P2000-392620
Dec. 21, 2001 (JP) ..... P2001-389192

(51) Int. Cl.
*B41J 2/175* (2006.01)
*B41J 2/14* (2006.01)
*B41J 2/16* (2006.01)

(52) U.S. Cl. ..... 347/86; 347/50

(58) Field of Classification Search ..... 347/50, 347/85, 86

See application file for complete search history.

(56) References Cited

U.S. PATENT DOCUMENTS 5,245,361 A * 9/1993 Kashimura et al. ..... 346/145
5,448,274 A * 9/1995 Hirabayashi et al. ..... 347/50
5,652,608 A * 7/1997 Watanabe et al. ..... 347/50
5,923,350 A * 7/1999 Ohnishi et al. ..... 347/50
5,980,021 A * 11/1999 Nagoshi et al. ..... 347/19
5,984,461 A * 11/1999 Faoro ..... 347/86
6,155,678 A 12/2000 Komplin et al.
6,196,670 B1 * 3/2001 Saruta ..... 347/86
6,361,138 B1 * 3/2002 Seino et al. ..... 347/19

FOREIGN PATENT DOCUMENTS

| | | | |
|---|---|---|---|
| EP | 1 004 449 | A2 | 5/2000 |
| EP | 1 1222 078 | A2 | 8/2001 |
| JP | 11-58765 | A | 3/1999 |
| JP | 2000-218818 | A | 8/2000 |
| JP | 2001-253087 | A | 9/2001 |
| WO | WO98/52762 | A2 | 11/1998 |

* cited by examiner

*Primary Examiner*—Stephen Meier
*Assistant Examiner*—Leonard Liang
(74) *Attorney, Agent, or Firm*—Sughrue Mion, PLLC

(57) ABSTRACT

A circuit board (8) having a storage means and electrodes capable of being connected to an external circuit is disposed on a side wall (5) of a container body 1 making up an ink cartridge on a side where an ink supply port (4) is formed. A positioning recessed portion (7) is formed which is open on the ink supply port (4) side and is adapted to engage a protruding portion (25) formed on a side of the recording apparatus.

40 Claims, 12 Drawing Sheets

INK CARTRIDGE FOR INK-JET RECORDING APPARATUS

BACKGROUND OF THE INVENTION

The present invention relates to an ink cartridge for an ink-jet recording apparatus, which is loaded on a carriage provided with a recording head for ejecting ink droplets and supplies ink, and which is provided with a storage medium for customer support.

An ink cartridge has been put to practical use which is provided with a storage means, wherein amounts of inks, the date of manufacture, a trademark, and the like are stored in the storage means as data, and data on such as the maintenance situation and the like transmitted from a main unit of a recording apparatus are also stored, as required, so as to realize customer support.

Such an ink cartridge needs to be loaded such that electrodes of the storage means are brought into contact with the recording apparatus, more particularly electrodes for contact which are provided in a holder.

Meanwhile, to smoothly load the ink cartridge in the holder having an ink supply needle implanted therein, a certain degree of play is required between them. For this reason, if vibrations or impacts are applied due to such as the printing operation or the movement of the main unit of the apparatus after the loading of the cartridge, the engagement between an ink supply port of the ink cartridge and an ink supply needle of the carriage can become loose. In such a case, there are drawbacks in that airtightness declines, and that printing becomes impossible in the event that the reading of data has become impossible due to faulty contact between the electrodes for contact of the recording apparatus and the electrodes of the storage means.

SUMMARY OF THE INVENTION

The present invention has been devised in view of the above-described problems, and its object is to provide an ink cartridge which makes it possible to reliably maintain connection between the ink supply needle communicating with the recording head and the ink supply port of the ink cartridge, and which makes it possible to ensure communication with the recording means with high reliability.

To attain the above object, in accordance with the invention there is provided an ink cartridge for an ink-jet recording apparatus comprising: a container body having an ink supply port; a storage element disposed on the container body; electrodes capable of being connected to contacts provided to the recording apparatus accommodating the container body therein; and a positioning system which is formed in the vicinity of the electrodes and is adapted to engage a positioning member of the recording apparatus.

In a state in which the ink cartridge is loaded on the carriage, the vicinity of the electrodes is restricted by the positioning member of the recording apparatus and the positioning system, so that positional offset with respect to the contacts due to vibrations and impacts is prevented.

The present disclosure relates to the subject matter contained in Japanese patent application Nos. 2000-392620 (filed on Dec. 25, 2000) and 2001-389192 (filed on Dec. 21, 2001), which are expressly incorporated herein by reference in their entireties.

DESCRIPTION OF THE PREFERRED EMBODIMENT

Hereafter, a detailed description will be given of the embodiments of the invention with reference to the drawings.

Figure 1:
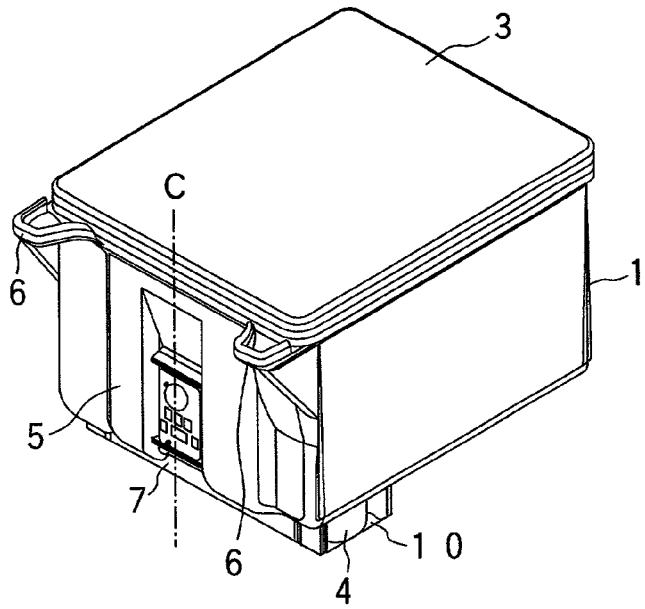
FIG. 1 is a perspective view illustrating an embodiment of an ink cartridge for an ink-jet recording apparatus in accordance with the invention.
Figure 2:
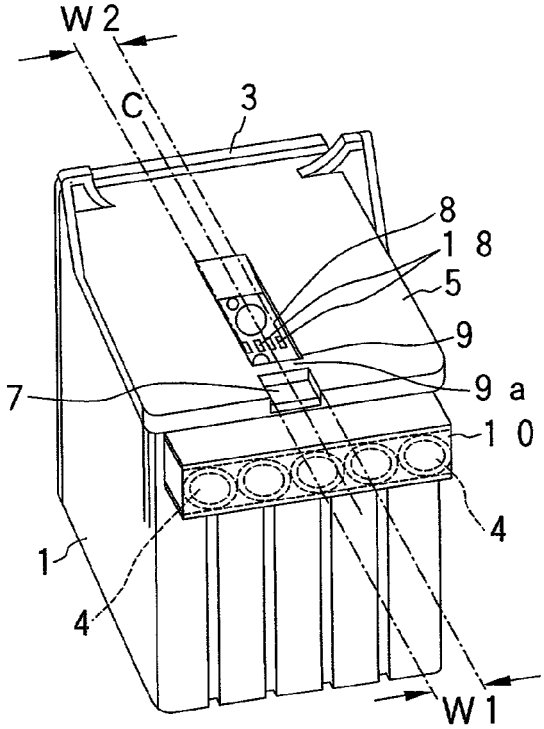
FIG. 2 is a perspective view illustrating a positioning recessed portion of the ink cartridge.
Figure 3:
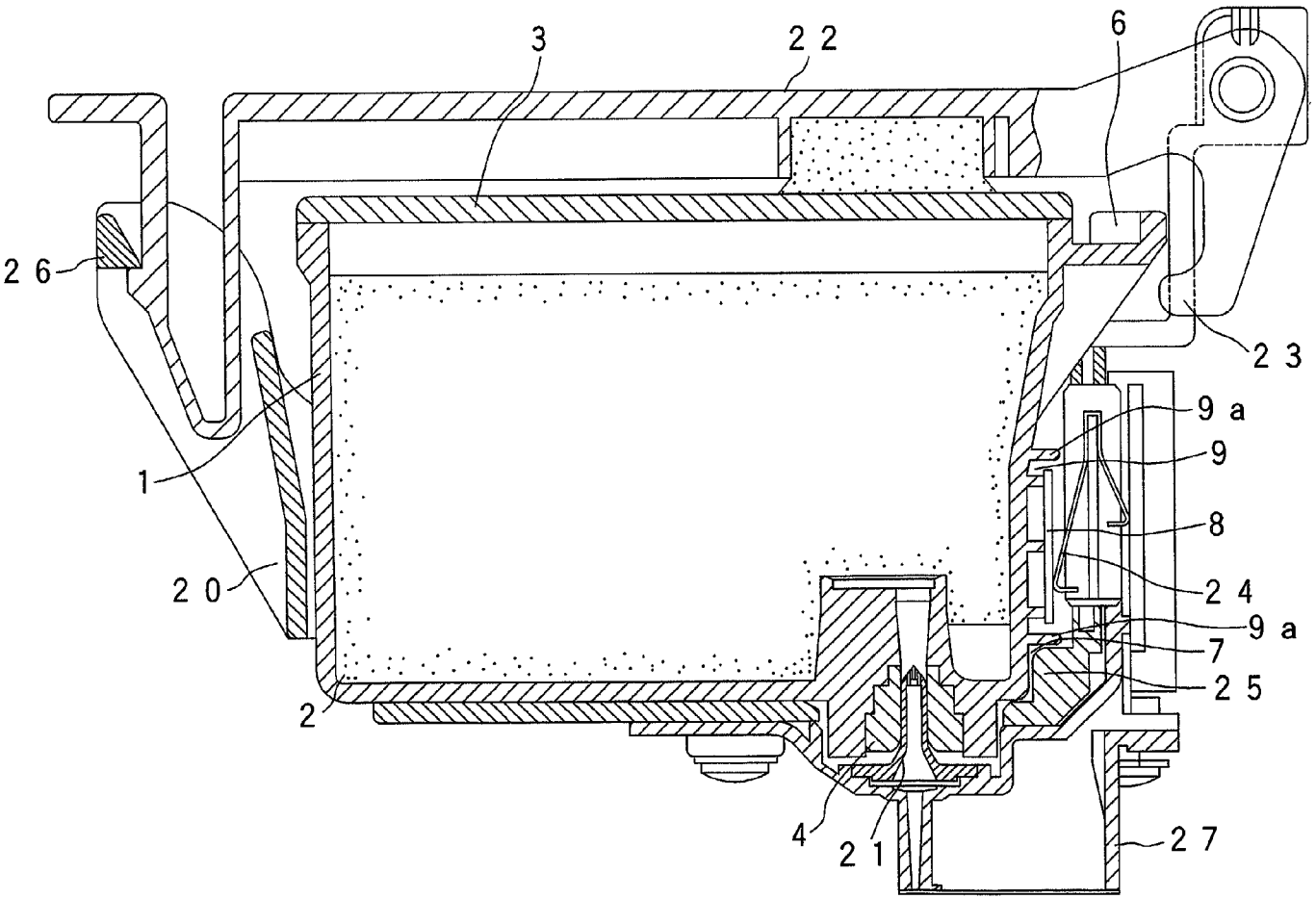
FIG. 3 is a cross-sectional view illustrating a state in which the ink cartridge is loaded in a cartridge holder disposed on a carriage of the recording apparatus in accordance with the embodiment of the invention.

FIGS. 1 and 2 illustrate an embodiment of an ink cartridge of the invention, and FIG. 3 illustrates a state in which the ink cartridge is loaded in a cartridge holder of a recording apparatus. The ink cartridge is constructed such that a container body 1 formed substantially as a rectangular parallelopiped is divided into a plurality of chambers so as to accommodate porous members 2 impregnated with respective different kinds of ink, and an upper surface is sealed by a cover 3.

Ink supply ports 4 are formed in a bottom surface of the container body 1 at positions respectively opposing ink supply needles 21 when the ink cartridge is loaded in a holder 20, and the ink supply ports 4 are sealed by a film 10, through which the ink supply needles 21 can be inserted, so as to prevent the leakage of the ink. In addition, a pair of protruded portions 6 for engaging projections 23 of a lever 22 are integrally formed at an upper end of an ink-supply-port side vertical wall 5.

A positioning recessed portion 7 extending upwardly from an ink supply port 4-side edge of the vertical wall 5, as well as a recessed portion 9 for accommodating a circuit board 8 constituting a storage means located thereabove, are formed in the vertical wall 5 on the ink supply port side in such a manner as to be located on a central line C.

Figure 4A:
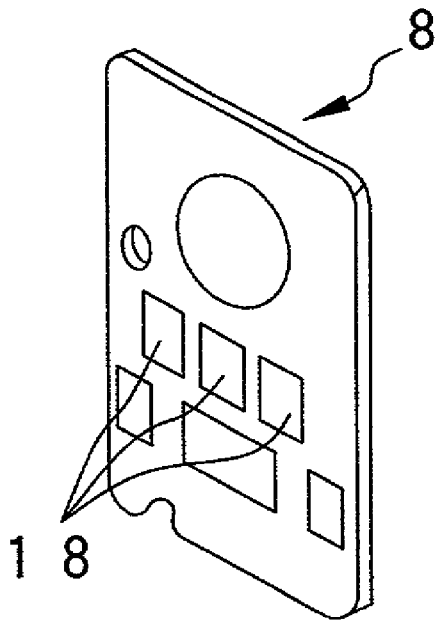
FIGS. 4A and 4B are perspective views of an example of a storage means provided on the ink cartridge.
Figure 4B:
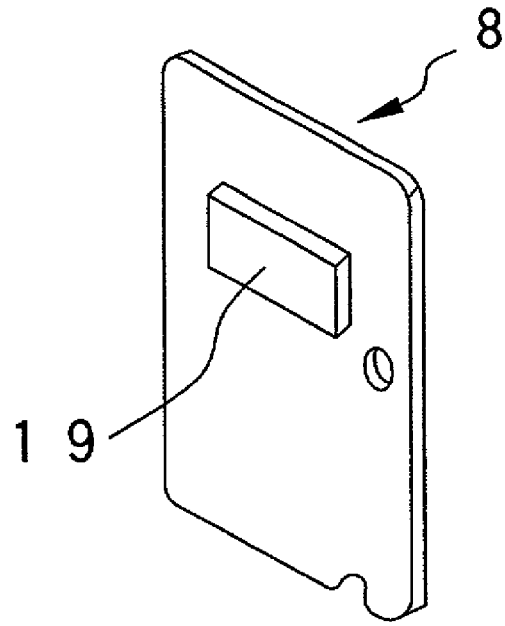

In the circuit board 8, as shown in FIGS. 4A and 4B, electrodes 18 are formed at positions opposing contact electrodes 24 of the holder 20 on that side of the circuit board 8 which becomes an obverse surface when it is mounted on the ink cartridge, while a storage element 19 connected to these electrodes 18 is mounted on the reverse surface thereof and is molded by an ink resistant material.

Amount of each ink, the date of manufacture, a trademark, and the like concerning in the ink cartridge which stores the ink and on which the storage element 19 is provided are stored in the storage element 19 as data, and data on such as the maintenance situation and the like transmitted from a main unit of a recording apparatus are also stored therein, as required.

The circuit board 8, the electrodes 18 and the storage element 19 constitutes the storage means.

Figure 5:
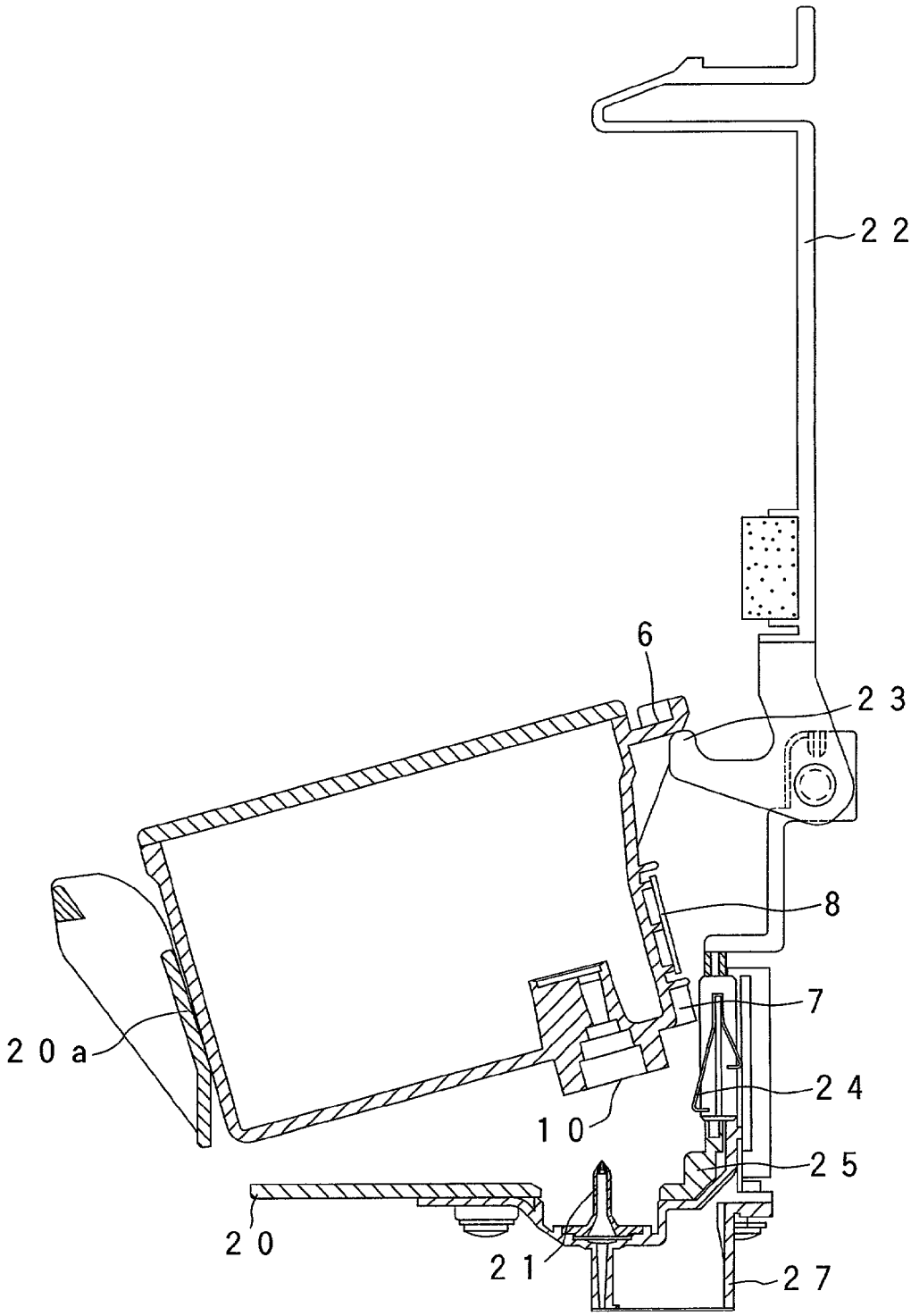
FIG. 5 is a cross-sectional view illustrating the process of loading the ink cartridge.

In this embodiment, if the lever 22 is opened up to a substantially vertical position, and the cartridge is loaded, the protruded portions 6 formed on the ink supply port side are received by the projections 23 of the lever 22, while the other end side is supported by an inclined surface portion 20*a* of the holder 20, so that the cartridge is held with its ink supply port side raised upward (FIG. 5).

Figure 6:
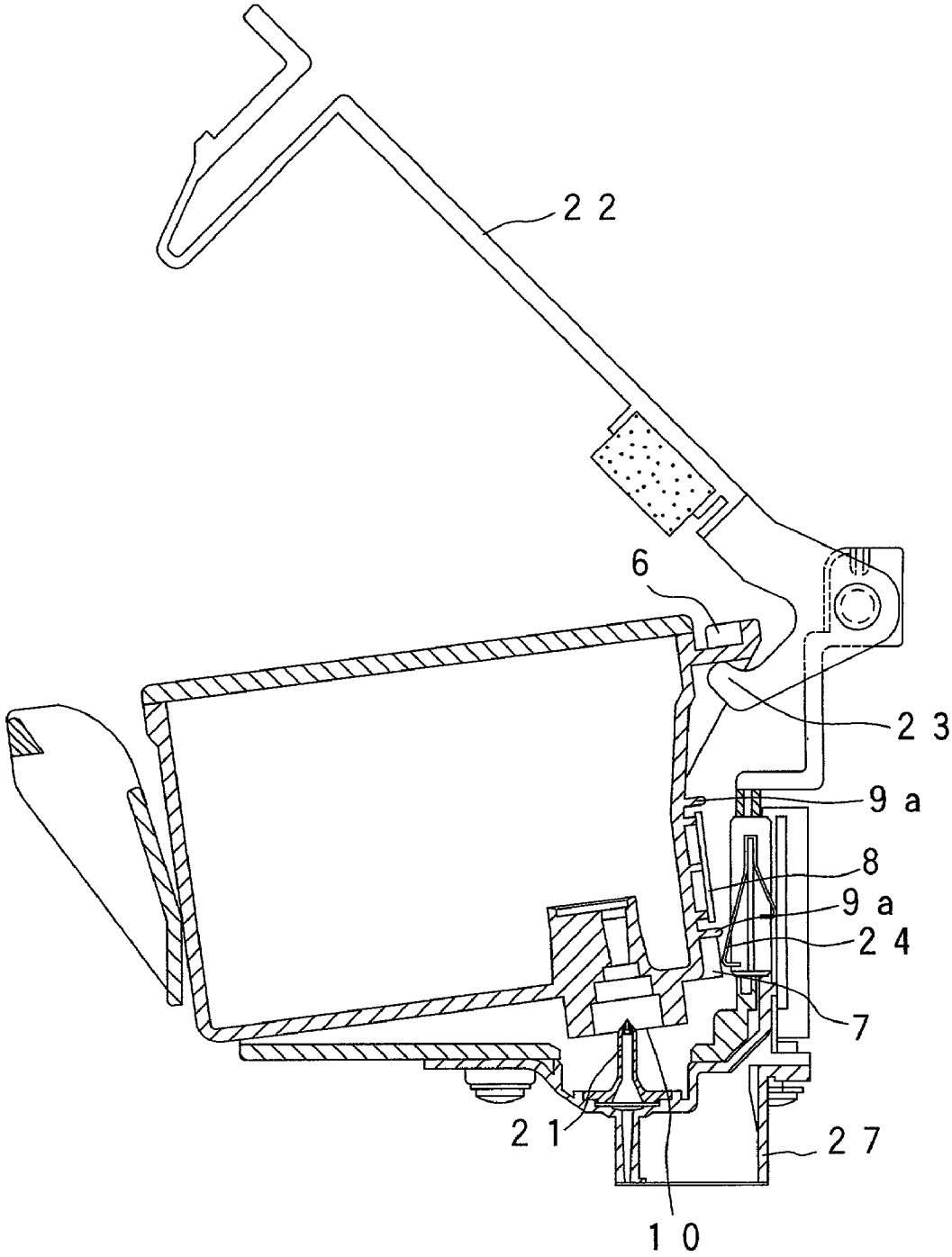
FIG. 6 is a cross-sectional view illustrating the process of loading the ink cartridge.
Figure 7:
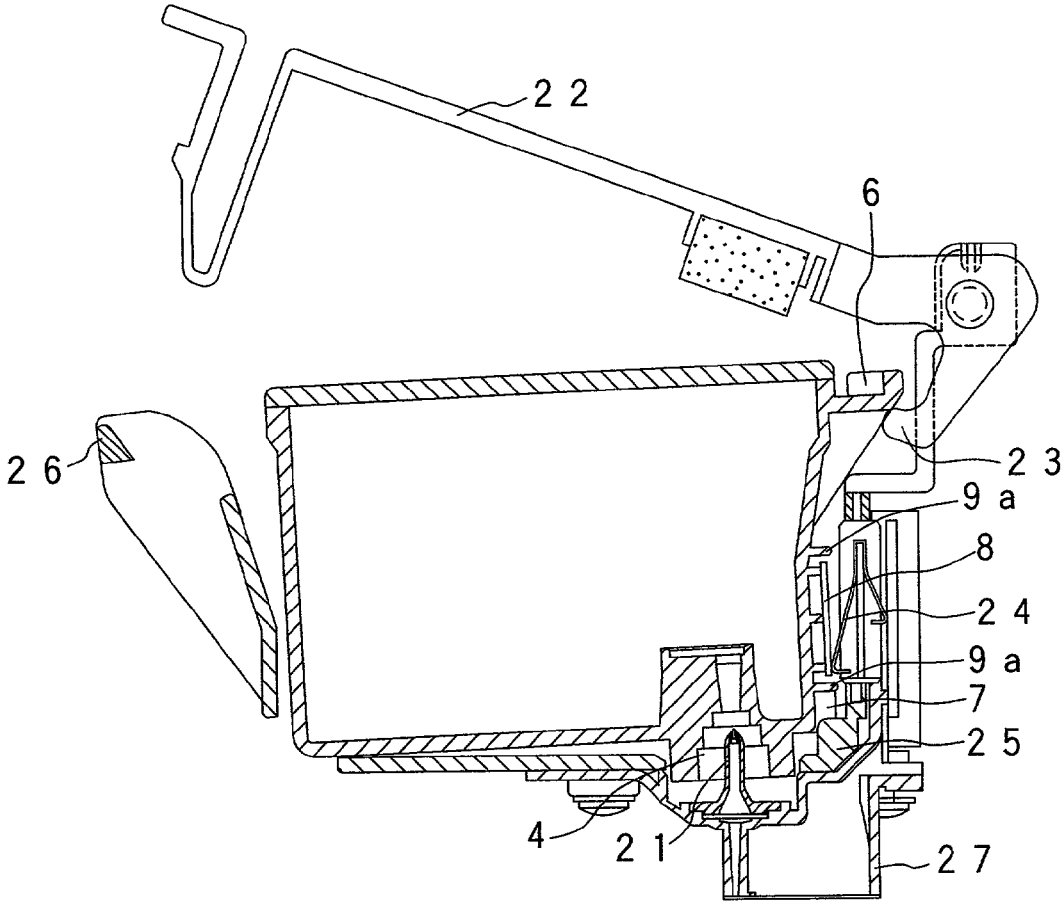
FIG. 7 is a cross-sectional view illustrating the process of loading the ink cartridge.

If the lever 22 is rotated in this state, the projections 23 are lowered, and the ink cartridge is lowered while substantially keeping its attitude persisting in the initial period of loading (FIG. 6). When the lever 22 is further rotated, a guiding protruding portion 25 of the holder 20 enters the positioning recessed portion 7 of the cartridge, and the cartridge, while being restricted by the guiding protruding portion 25, is subsequently lowered to a position where the film 10 covering the ink supply ports 4 contacts tips of the ink supply needles 21 to be pierced thereby (FIG. 7).

If the lever 22 is further rotated in this state, a portion of the ink cartridge located immediately above the ink supply ports 4 is pressed, and the ink supply ports 4 are pushed down to further receive the ink supply needles 21. Then, when the lever 22 is pushed down to the last, the lever 22 is fixed by a hook portion 26 in a state in which the lever 22 constantly presses the cover 3 resiliently toward the ink supply needle side.

Figure 8:
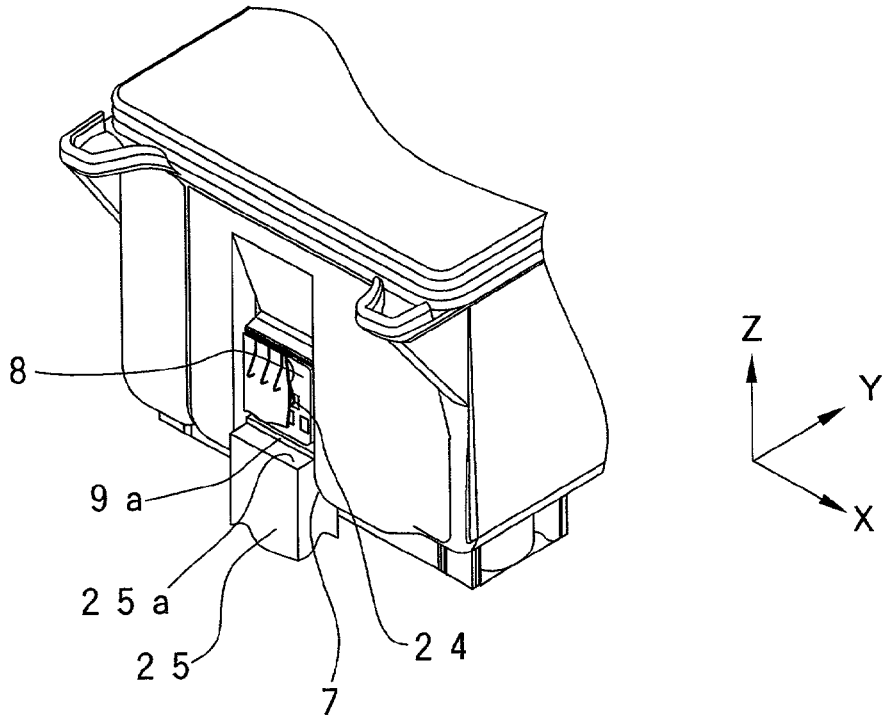
FIG. 8 is an enlarged perspective view of a positioned state with a portion of a board having contact electrodes being broken away.

Consequently, the ink cartridge is fixed in a state in which its upper portion is restricted by the lever 22, while the vicinity of the circuit board 8 constituting the storage means is fixed in a state of being restricted by the guiding protruding portion 25, as shown in FIG. 8, i.e., in a state of being restricted by the guiding protruding portion 25 in the moving direction of the carriage (i.e., in the X direction in the drawing) and in the paper feeding direction (in the Y direction in the drawing) and in a state of being restricted in the vertical direction (in the Z direction in the drawing) by a top surface 25*a* of the protruding portion 25 and by a lower surface of a wall 9*a* defining the recessed portion 9 for accommodating the circuit board 8.

As shown in FIG. 2, this wall 9*a* extends in parallel to an electrode arrangement direction, and a width W1 is wider than a width W2 of an area where the electrodes 18 are arranged. Further, a width of the protruding portion 25 is substantially the same as the width of the wall 9*a*. Accordingly, the electrodes 18 can be positioned to and held at accurate positions, whereby the reliable contact can be realized.

Consequently, irrespective of vibrations during printing and vibrations or impacts due to such as the movement of the recording apparatus, the ink supply ports 4 are able to retain airtightness and maintain a state of engagement with respect to the ink supply needles 21, while the electrodes 18 of the circuit board 8 are able to maintain a state of connection with the contact electrodes 24, so as to reliably supply ink to a recording head 27 and reliably read data stored in the storage element 19.

When the ink in the ink cartridge has been consumed, if the engagement with the hook portion 26 is canceled and the lever 22 is rotated upward, the projections 23 of the lever 22 are engaged with the undersides of the protruded portions 6 of the ink cartridge (FIG. 6). If the lever 22 is further rotated in this state, the ink cartridge is pulled upward by the lever 22, and its engagement with the ink supply needles 21 is canceled. If the lever 22 is fully rotated up to the substantially vertical position, the ink cartridge can be removed easily since an upper half portion of the ink cartridge is exposed with the ink supply port-side protruded portions 6 supported by the projections 23 of the lever 22; as shown in FIG. 5.

Figure 9:
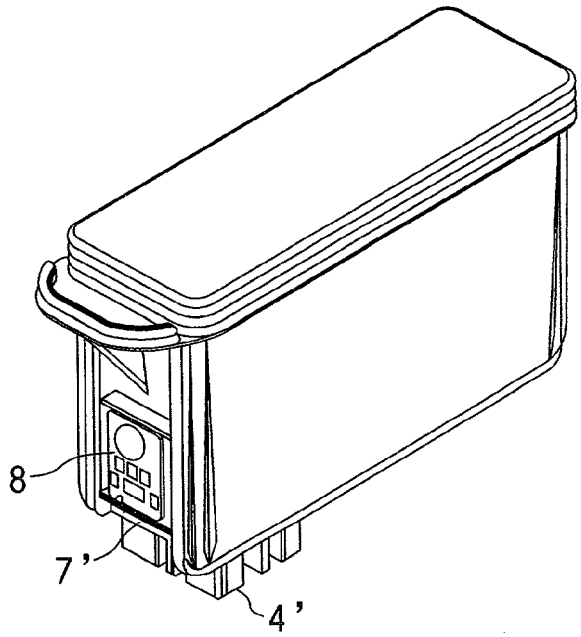
FIG. 9 is a perspective view illustrating another embodiment of the ink cartridge to which a guide means of the invention is applied.

It should be noted that although in the above-described embodiment a description has been given of the cartridge accommodating plural different kinds of ink in the same container, it is apparent that the same effect is demonstrated even in the case of the cartridge accommodating a single kind of ink if, as shown in FIG. 9, a positioning recessed portion 7' is formed on the side where the recessed portion for accommodating the circuit board 8 is formed and an ink supply port 4' is formed, i.e., on the lower side in this embodiment.

It should be noted that although in the above-described embodiments a description has been given of the ink cartridge of the type in which the ink cartridge is loaded by engaging the lever, it is apparent that the same effect is demonstrated if the invention is applied to the ink cartridge of the type in which the ink cartridge is loaded and fixed in the recording apparatus by being manually pressed.

Figure 10:
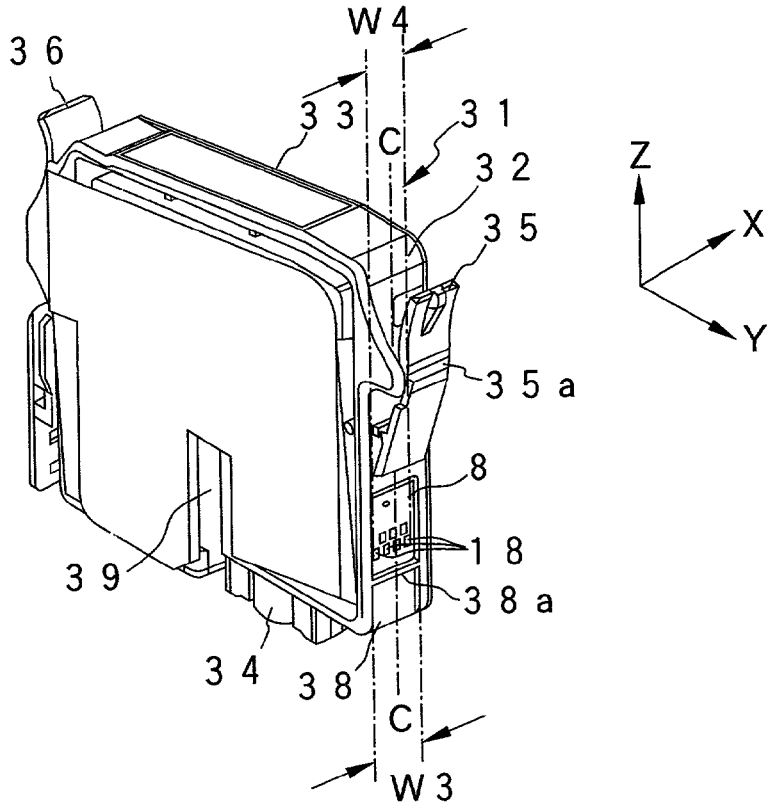
FIG. 10 is a perspective view illustrating still another embodiment of the ink cartridge in accordance with the invention.

FIG. 10 shows still another embodiment of the above-described ink cartridge, and a cartridge 31 is mainly comprised of a container body 32 having one side open and shaped in a flat rectangular shape as well as a cover 33 for sealing this opening. An ink supply port 34 is formed integrally with the container body 32 on the front end side in the inserting direction, i.e., on the lower side in this embodiment, while a pair of retaining members 35 and 36 are respectively formed on upper sides of the container body 32 integrally therewith.

A circuit board 8 having electrodes 18 and a storage element 19 is disposed below the ink supply port-side retaining member 35. Formed at a front end of the ink cartridge in the inserting direction, i.e., on the lower portion side in this embodiment, is a positioning recessed portion 38 which is open on the ink supply port 34 side so as to be positioned substantially on a center line C of the circuit board 8 and which extends toward a rear end thereof in the inserting direction, i.e., toward an upper portion thereof.

It should be noted that reference numeral 39 in the drawing denotes a positioning slit.

Figure 11A:
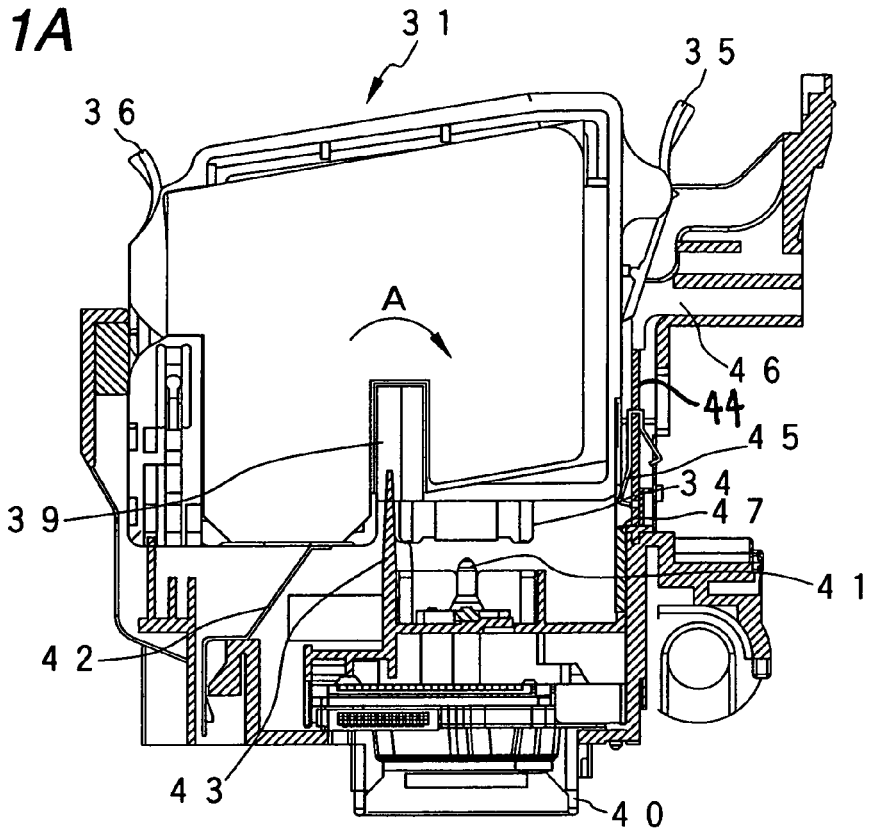
FIGS. 11A and 11B are cross-sectional views illustrating the process in which the ink cartridge shown in FIG. 10 is loaded in the holder.

FIG. 11A shows an embodiment of the holder in which the above-described cartridge 31 is loaded. A pressing member, i.e., a leaf spring 42 in this embodiment, is provided in an area spaced apart from an area where an ink supply needle 41 communicating with a recording head 40 is uprightly provided. In addition, a positioning projecting piece 43 is formed between the leaf spring 42 and the ink supply needle 41 in such a manner as to extend in the inserting and withdrawing directions of the cartridge. Further, contact electrodes 45 are arranged on a side wall 44 on the ink supply needle 41 side.

A recessed portion 46 which is to be engaged with a projection 35*a* of the retaining member 35 of the ink cartridge 31 is formed above the electrodes 45, while a guiding protruding portion 47 is formed below the electrodes 45.

In this embodiment, if the ink cartridge 31 is inserted with the ink supply port 34 set on the innermost side as shown in FIG. 11A, and is pushed in against the leaf spring 42, the slit 39 is restricted by the projecting piece 43. Consequently, even if the cartridge 31 is subjected to a rotational torque (arrow A in the drawing) by the leaf spring 42 disposed in a one-sidedly offset manner such that the ink supply port 41 side becomes lower, the attitude of the cartridge 31 is restricted so as to be set in predetermined inserting and withdrawing directions, i.e., so as to be parallel with the vertical direction in this embodiment.

Figure 11B:
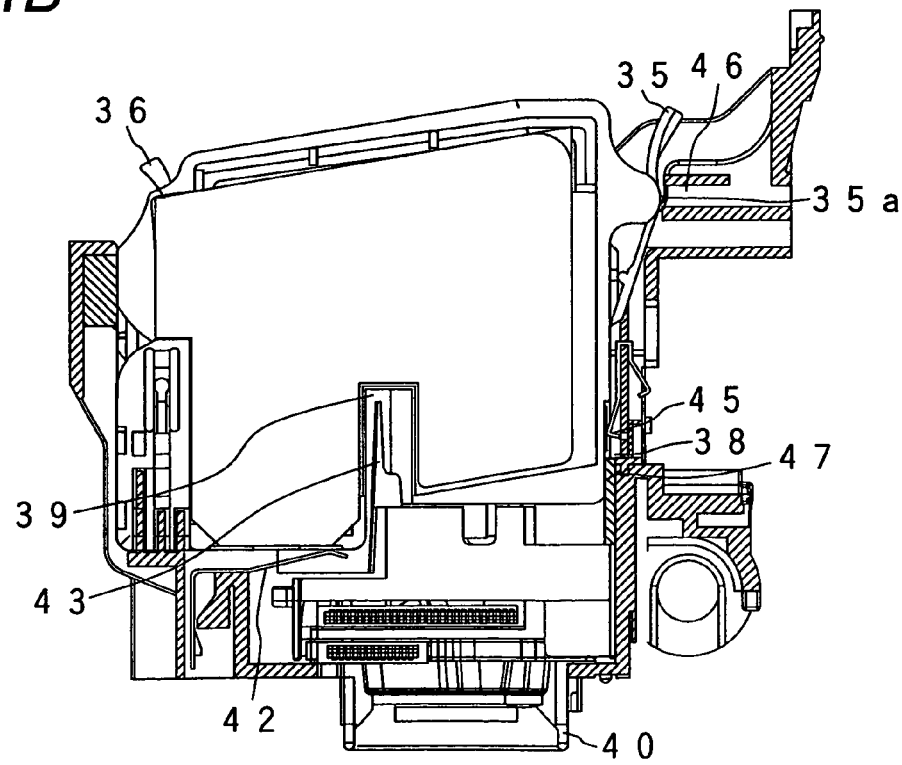

If the cartridge 31 is further pushed in against the leaf spring 42, the guiding protruding portion 47 advances into the positioning recessed portion 38 of the cartridge 31, as shown in FIG. 11B. Subsequently, while the cartridge 31 is being restricted by the guiding protruding portion 47, the ink supply port 34 comes into contact with the tip of the ink supply needle 41, and when the ink supply needle 41 has advanced up to a predetermined point, the projection 35*a* of the retaining member 35 falls into the recessed portion 46 against the resiliency of the overall retaining member 35 and is engaged therein.

Figure 12:
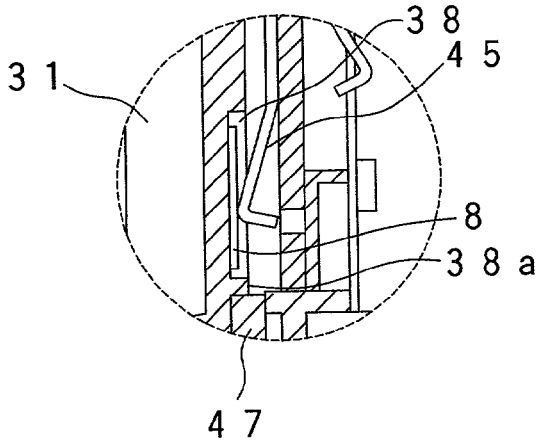
FIG. 12 is an enlarged cross-sectional view of an area of contact between the ink cartridge and the holder.

In the loaded state, the position in the inserting and withdrawing directions of the surface of the cartridge 31 where the circuit board 8 is provided is restricted by the projection 35*a* of the retaining member 35. Consequently, the electrodes 18 are pressed against the contact electrodes 45 of the holder by the urging force (the force acting in the direction of arrow A in the drawing) of the leaf spring 42. Further, as shown in FIG. 12, the upper end of the guiding protruding portion 47 serves as a wall to be contacted with an upper end 38*a* of the positioning recessed portion 38.

As shown in FIG. 10, the upper end 38*a* of the positioning recessed portion 38 extends in parallel to an electrode arrangement direction, and a width W3 thereof is wider than a width W4 of an area where the electrodes 18 are arranged. A width of the protruding portion 47 is substantially the same as the width of the upper end 38*a* of the positioning recessed portion 38. Consequently, the cartridge 31 is fixed in a state in which it is restricted by the guiding protruding portion 47, as shown in FIG. 12, i.e., in a state of being restricted by the guiding protruding portion 47 in the moving direction of the carriage (i.e., in the X direction in the drawing), in the paper feeding direction (in the Y direction in the drawing) and in the cartridge insertion direction (in the Z direction in the drawing). Thus, the contact is reliably maintained irrespective of the vibrations during printing.

Meanwhile, in a case where the ink cartridge 31 is removed from the holder for the purpose of replacement or the like, if the retaining member 35 is resiliently pressed, the projection 35*a* of the retaining member 35 is disengaged from the recessed portion 46 of the holder. If the cartridge 31 is pulled out in this state, the cartridge 31 moves in parallel with the ink supply needle 41 while being subjected to the urging force of the leaf spring 42 and being guided by the guiding protruding portion 47 in the moving direction. Thus, the cartridge 31 can be removed without causing a bending force or the like to the ink supply needle 41.

Figure 13:
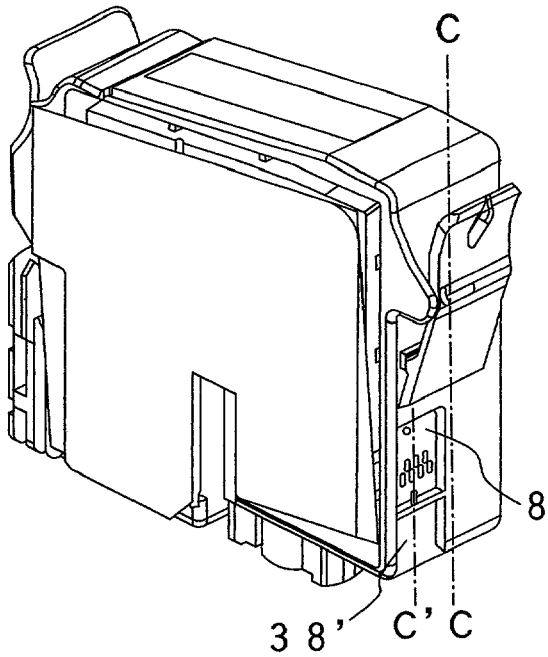
FIG. 13 is a perspective view showing yet another embodiment of the ink cartridge in accordance with the invention.

In the aforementioned embodiments, the positioning recess (7, 7', 38) is disposed on the center line C of the ink cartridge, and the circuit board 8 is disposed such that its center line is coincident with the center line C of the ink cartridge. The invention, however, is not restricted thereto or thereby. For example, as shown in FIG. 13, in case where the positioning recessed portion 38' is formed at an offset position in the widthwise direction front the center line C of the ink cartridge, and the circuit board 8 is disposed to be coincident with a center line C' of the recessed portion 38, the same or similar effect can be obtained if the guiding protruding portion 47 is formed at a position corresponding to the recessed portion 38'.

Figure 14:
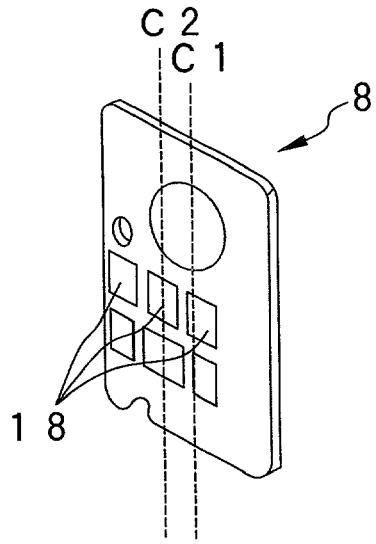
FIG. 14 is a perspective view showing another example of the circuit board attached to the ink cartridge.

As shown in FIG. 14, the center line of the circuit board generally means the center line C1 of the circuit board per se in the widthwise direction, but also includes a line C2 passing through a center of an area where the electrodes 18 are arranged in case where a set of the electrodes are located at an offset position.

Figure 15A:
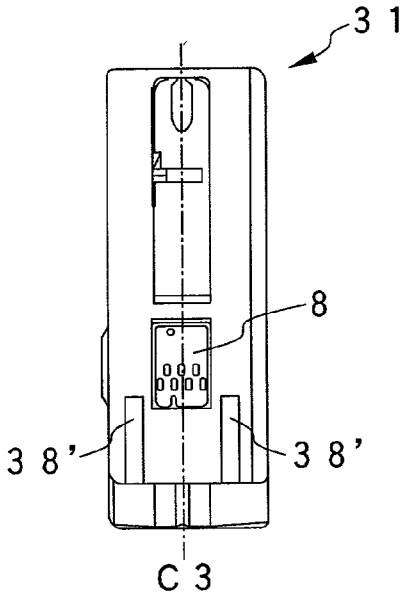
FIGS. 15A and 15B are front views showing other examples of the ink cartridge in accordance with the invention.

In the aforementioned embodiments, a single positioning recess (7, 7', 38) is formed in the ink cartridge to be coincident with the center line of the circuit board 8. However, a plurality of positioning recesses may be formed in the ink cartridge at positions different from the center line C3 of the circuit board 8. For example, as shown in FIG. 15A, a plurality of positioning recesses (in this modification, two positioning recesses 38' and 38', each being opened at its leading end in the cartridge insertion direction) may be provided symmetrically with respect to the center line C3 of the circuit board 8, or at positions different from the center line C3 of the circuit board 8.

Figure 15B:
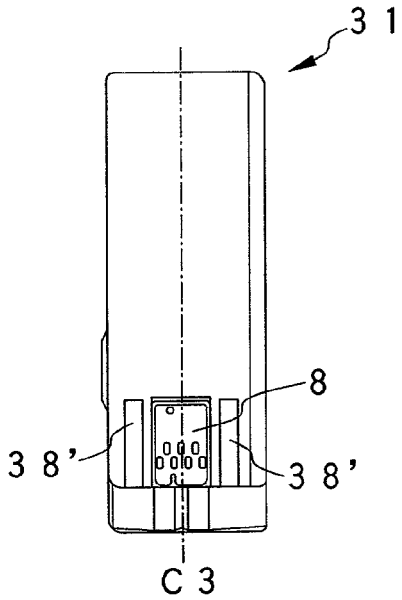

In case where the recesses 38' and 38' are formed at positions different from the center line of the circuit board 8, the recesses 38' and 38' can be formed to have the same height as that of the circuit board 8, as shown, for example, in FIG. 15B, and therefore it is possible to more reliably position the area of the circuit board 8.

Figure 16:
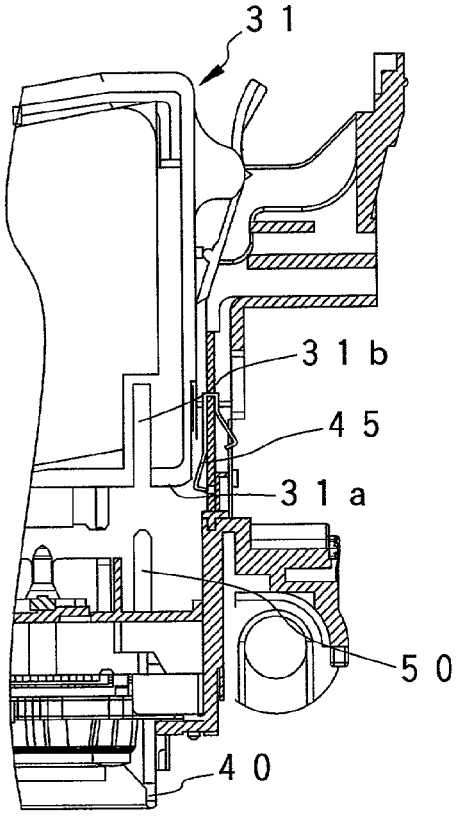
FIG. 16 is a sectional view showing further another embodiment of the ink cartridge in accordance with the invention, and a structure of a holder adapted thereto.

Further, although in the aforementioned embodiments the positioning recess is shaped to be open at a bottom wall of the ink cartridge (a surface where the ink supply port is provided) and a side wall of the ink cartridge (a surface where the circuit board is provided), the positioning recess may be shaped as a blind hole which is open only at the bottom wall of the ink cartridge. For example, as shown in FIG. 16, a blind hole 31*b*, the leading end of which is opened, may be formed to extend from a surface, serving as a leading end surface when the ink cartridge 31 is inserted (i.e. the bottom surface 31*a*), to the interior of the ink cartridge 31. Correspondingly, a protruding portion 50 may be formed in the recording apparatus to engage the blind hole 31*b*.

Figure 17A:
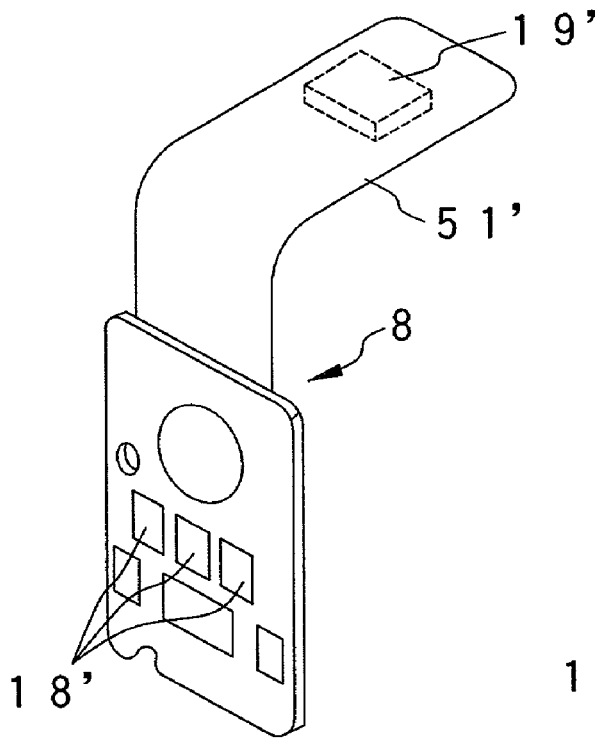
FIGS. 17A and 17B are perspective views showing other examples of the storage means applicable to the ink cartridge.
Figure 17B:
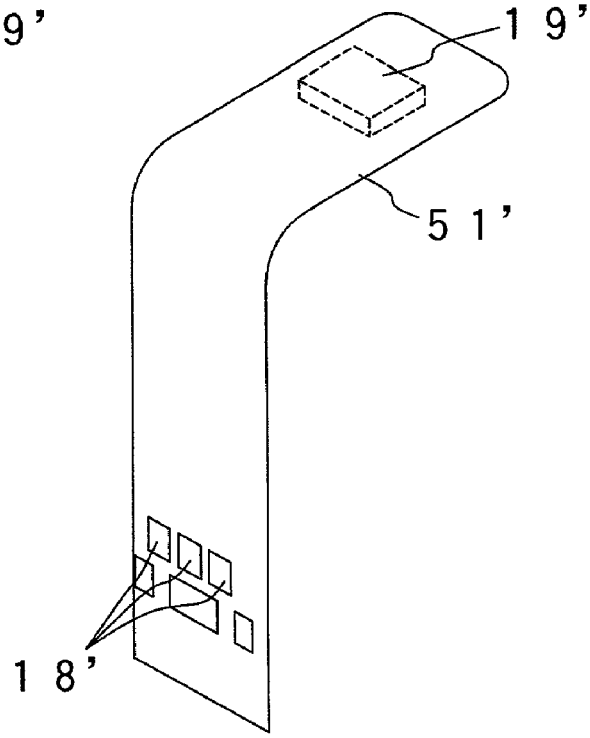

Further, although in the aforementioned embodiments the electrodes 18 are mounted on the front surface of the circuit board 8 and the storage element 19 is mounted on the rear surface, this arrangement may be modified such that, as shown in FIG. 17, the electrodes 18' to be contacted with the contacts 45 are only provided on the circuit board 8', and the storage element 19' is mounted on a flexible cable 51' connected to the electrodes 18.

Moreover, the flexible cable 51' may be extended so that the electrodes 18' are formed in an area opposite from an area where the storage element 19' is mounted.

According to this modification, it is possible not only to omit the circuit board 8, but also to dispense with a process for connection between the circuit board 8 and the flexible cable 51'. Therefore, the structure can be made simple and the cost can be reduced.

According to these modifications, it is possible to locate the electrodes 18' of the circuit board 8 or flexible cable 51' at positions that facilitate contact with and guide to the contact electrodes 45 of the recording apparatus, while the storage element 19 can be located at a desired position, for example, on the upper surface of the ink cartridge, using the flexible cable 51'. Therefore, the design freedom can be increased.

As described above, according to the present invention, in the state in which the ink cartridge has been loaded in the recording apparatus, the vicinity of the electrodes is restricted by the positioning member of the recording apparatus and the positioning system, so that positional offset of the contacts due to vibrations and impacts can be prevented.

What is claimed is:

1. An ink cartridge for an ink-jet recording apparatus comprising:

a container body having an ink supply port, the container body including a front wall, a back wall and a lower surface;

a storage element disposed on said container body;

electrodes to be in contact with respective contacts provided in the recording apparatus accommodating the container body therein; and a recess located at a lower portion of the front wall of the ink cartridge and between the ink supply port and the electrodes and is adapted to contact a protrusion of said recording apparatus to maintain the electrodes in contact with respective contacts, wherein the recess includes a first width along a carriage moving direction, the protrusion includes a second width along the carriage moving direction, the first width and the second width being substantially the same, and recess receives the protrusion to align the electrodes with respective contacts in a carriage moving direction in a state in which the electrodes contact the contacts, the ink cartridge further comprising:

a front retaining lever disposed at the front wall and above the electrodes, and resiliently disposed at an acute angle with respect to the front wall, and the front retaining lever comprising:

a base attached to the front wall, upwardly pointing distal end, the acute angle being formed by the distal end, the base and a portion of the front wall above the base, an exterior surface facing away from the front wall and a projection formed at the exterior surface, the projection slideably engaging into a recess of a carriage against a resiliency of the front retaining lever, a back retaining member disposed at the back wall, a slit disposed at the lower surface behind the ink supply port, extending along an inserting direction and a withdrawing direction of the ink cartridge and adapted to receive a projecting member of the recording apparatus.

2. The ink cartridge according to claim 1, wherein the recess includes at least one recess that has an opening at a leading end thereof in an ink cartridge insertion direction, and that is engageable with the protrusion.

3. The ink cartridge according to claim 2, wherein the at least one recess includes a pair of recesses located opposite from each other with respect to the electrodes.

4. The ink cartridge according to claim 2, wherein the recess has an upper end wall to be contacted with an upper end of the protrusion.

5. The ink cartridge according to claim 4, wherein the wall extends in parallel to a direction in which the electrodes are arranged.

6. The ink cartridge according to claim 4, wherein a contact area between the wall and the recess is wider than a width of an area in which the electrodes are arranged.

7. The ink cartridge according to claim 1, wherein the positioning system includes a blind hole opened at a bottom surface of the container body.

8. The ink cartridge according to claim 1, wherein the storage element and the electrodes are mounted on a same flexible cable.

9. The ink cartridge according to claim 1, wherein the recess contacts the protrusion to further align the electrodes with respective contacts in at least one direction of a paper feeding direction and a vertical direction in a state in which the electrodes contact the contacts.

10. The ink cartridge according to claim 1, wherein the recess is located at an edge portion where a bottom wall formed with the ink supply port meets a side wall formed with the electrodes.

11. The ink cartridge according to claim 10, wherein the recess extends from the bottom wall formed with the ink supply port to reach at least a lower end of a circuit board having the electrodes.

12. The ink cartridge according to claim 1, wherein the recess extends from a bottom wall formed with the ink supply port to reach at least a lower end of a circuit board having the electrodes.

13. The ink cartridge according to claim 1, wherein the recess comprises a first sidewall and a second sidewall, the first sidewall opposes the second sidewall, and the protrusion is received in the recess.

14. An ink cartridge for an ink-jet recording apparatus, comprising:

a container body having an ink supply port, the container body including a front wall, a back wall and a lower surface;

electrodes which are to be in contact with respective contacts provided in the recording apparatus and which are formed in a side where the ink supply port is provided;

a storage element provided to a predetermined area of the container body and connected to the electrodes; and a positioning recessed portion located at a lower portion of the front wall of the ink cartridge and open to the side where the ink supply port is provided, and receives a protruding portion firmed in the recording apparatus to maintain the electrodes in contact with respective contacts, the positioning recessed portion having a first width along a carriage moving direction, the protruding portion having a second width along the carriage moving direction, wherein the first width and the second width are substantially the same, wherein the positioning recessed portion contacts the positioning member to align the electrodes with respective contacts in a carriage moving direction in a state in which the electrodes contact the contacts, the ink cartridge further comprising:

a front retaining lever disposed at the front wall and above the electrodes, and resiliently disposed at an acute angle with respect to the front wall, and the front retaining lever comprising:

a base attached to the front wall, a upwardly pointing distal end, the acute angle being formed by the distal end, the base and a portion of the front wall above the base, an exterior surface facing away from the front wall and a projection formed at the exterior surface, the projection slideably engaging into a recess of a carriage against a resiliency of the front retaining lever, a back retaining member disposed at the back wall, a slit disposed at the lower surface behind the ink supply port, extending along an inserting direction and a withdrawing direction of the ink cartridge and adapted to receive a projecting member of the recording apparatus.

15. The ink cartridge according to claim 14, wherein a circuit board having the electrodes is accommodated in a recessed portion formed in said container body.

16. The ink cartridge according to claim 14, wherein said positioning recessed portion is formed at a position below a circuit board having the electrodes.

17. The ink cartridge according to claim 14, wherein a pair of the positioning recesses are provided to be located opposite from each other with respect to the electrodes.

18. The ink cartridge according to claim 14, wherein said container body has a recessed portion for accommodating a circuit board having the electrodes, and has a wall which defines said recessed portion and is brought into contact with a top surface of said protruding portion.

19. The ink cartridge according to claim 18, wherein the wall extends in parallel to a direction in which the electrodes are arranged.

20. The ink cartridge according to claim 18, wherein a contact area between the wall and the protruding portion is wider than a width of an area where the electrodes are arranged.

21. The ink cartridge according to claim 14, wherein the storage element is mounted on a circuit board.

22. The ink cartridge according to claim 14, wherein a flexible cable is connected to a circuit board having the electrodes, and the storage element is connected to the electrodes through the flexible cable.

23. The ink cartridge according to claim 22, wherein the storage element is mounted on the flexible cable.

24. The ink cartridge according to claim 14, wherein the storage element and the electrodes are mounted on a same flexible cable.

25. The ink cartridge according to claim 14, wherein the positioning recessed portion contacts the positioning member to further align the electrodes with respective contacts in at least one direction of a paper feeding direction and a vertical direction in a state in which the electrodes contact the contacts.

26. The ink cartridge according to claim 14, wherein the positioning recessed portion comprises a first sidewall and a second sidewall, the first sidewall opposes the second sidewall, and the protruding portion is received in the recess.

27. An ink cartridge for an ink-jet recording apparatus having a protrusion and contact electrodes, comprising:

a container body having an ink supply port, the container body including a front wall, a back wall and a lower surface;

a storage element associated with said container body;

a recess disposed at a lower portion of the front wall of the ink cartridge, having an opening along an insertion direction of the ink cartridge, wherein a width of the opening along a direction perpendicular to the insertion direction and parallel to a carriage moving direction is substantially equal to a width of the protrusion along the direction perpendicular to the insertion direction and parallel to the carriage moving direction; and cartridge electrodes disposed at a side of the ink cartridge, contacting respective contact electrodes provided in the recording apparatus accommodating the ink jet cartridge therein, wherein the recess contacts the protrusion to align the cartridge electrodes with respective contact electrodes in a carriage moving direction in a state in which the cartridge electrodes contact the contact electrodes, the ink cartridge further comprising:

a front retaining lever disposed at the front wall and above the cartridge electrodes, and resiliently disposed at an acute angle with respect to the front wall, and the front retaining lever comprising:

a base attached to the front wall, a upwardly pointing distal end, the acute angle being formed by the distal end, the base and a portion of the front wall above the base, an exterior surface facing away from the front wall and a projection formed at the exterior surface, the projection slideably engaging into a recess of a carriage against a resiliency of the front retaining lever, a back retaining member disposed at the back wall, a slit disposed at the lower surface behind the ink supply port, extending along an inserting direction and a withdrawing direction of the ink cartridge and adapted to receive a projecting member of the recording apparatus.

28. The ink cartridge according to claim 27, wherein the protrusion fitted into the recess fixedly maintains electrical contact between the cartridge electrodes and respective contact electrodes.

29. The ink cartridge according to claim 27, wherein the cartridge electrodes are on a circuit board and the recess is disposed substantially on a centerline of the circuit board and the centerline of the circuit board is coincident with a centerline of the ink jet cartridge.

30. The ink cartridge according to claim 27, wherein a the cartridge electrodes are on a circuit board and the recess is disposed substantially on a centerline of the circuit board and the centerline of the circuit board is offset from a centerline of the ink jet cartridge.

31. The ink cartridge according to claim 27, wherein the recess is a first recess of a plurality of recesses and the protrusion is a first protrusion of a plurality of protrusions.

32. The ink cartridge according to claim 31, wherein each of the plurality of recesses is disposed at the bottom of the ink cartridge, an opening of each of the plurality of recesses is disposed along the insertion direction of the ink cartridge, and a width of the opening of each of the plurality of recesses along a main scanning direction is substantially equal to a width of a respective one of the plurality of protrusions along the main scanning direction.

33. The ink cartridge according to claim 32, wherein the cartridge electrodes are disposed between the first recess and a second recess of the plurality of recesses along the main scanning direction.

34. An ink cartridge for an ink-jet recording apparatus comprising:

a container body having an ink supply port, the container body including a front wall, a back wall and a lower surface;

a storage element disposed on said container body;

electrodes to be in contact with respective contacts provided in the recording apparatus accommodating the container body therein; and a recess located at a lower portion of the front wall of the ink cartridge and proximate the electrodes and adapted to contact a protrusion of said recording apparatus to maintain the electrodes in contact with respective contacts along at least a carriage moving direction, wherein the recess includes a first horizontal width along the carriage moving direction, the protrusion includes a second horizontal width along the carriage moving direction and the first width and the second width are substantially the same, the ink cartridge further comprising:

a front retaining lever disposed at the front wall and above the electrodes, and resiliently disposed at an acute angle with respect to the front wall, and the front retaining lever comprising:

a base attached to the front wall, a upwardly pointing distal end, the acute angle being formed by the distal end, the base and a portion of the front wall above the base, an exterior surface facing away from the front wall and a projection formed at the exterior surface, the projection slideably engaging into a recess of a carriage against a resiliency of the front retaining lever, a back retaining member disposed at the back wall, a slit disposed at the lower surface behind the ink supply port, extending along an inserting direction and a withdrawing direction of the ink cartridge and adapted to receive a projecting member of the recording apparatus.

35. An ink cartridge according to claim 34, wherein each of the electrodes has a third horizontal width along the carriage moving direction substantially equal to or greater than a difference between the first horizontal width of the recess and the second horizontal width of the protrusion.

36. The ink cartridge according to claim 13, wherein the first horizontal width is a distance between two vertical walls of the recess and the second horizontal distance is a distance between the two vertical walls of the protrusion.

37. The ink cartridge according to claim 34, wherein the carriage moving direction is perpendicular to a paper feeding direction and a cartridge insertion direction.

38. The ink cartridge according to claim 34, wherein the recess comprises a first sidewall and a second sidewall, the first sidewall opposes the second sidewall, and the protrusion is received in the recess.

39. The ink cartridge according to claim 34, wherein the positioning system includes a pair of side walls disposed adjacent to the electrodes so that the electrodes are located between the side walls in the carriage moving direction.

40. The ink cartridge according to claim 39, wherein the side walls are defined respectively by inner walls of recesses formed in the container body.

* * * * *